US009140249B2

(12) United States Patent
Hayashi et al.

(10) Patent No.: US 9,140,249 B2
(45) Date of Patent: Sep. 22, 2015

(54) SWASH PLATE TYPE COMPRESSOR

(71) Applicant: KABUSHIKI KAISHA TOYOTA JIDOSHOKKI, Aichi-ken (JP)

(72) Inventors: Genki Hayashi, Kariya (JP); Nobutoshi Bannno, Kariya (JP); Hitoshi Inukai, Kariya (JP); Naoki Goto, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 235 days.

(21) Appl. No.: 13/792,852

(22) Filed: Mar. 11, 2013

(65) Prior Publication Data

US 2013/0259713 A1 Oct. 3, 2013

(30) Foreign Application Priority Data

Mar. 30, 2012 (JP) ..... P2012-080029

(51) Int. Cl.
*F04B 27/10* (2006.01)
*F04B 27/08* (2006.01)
(Continued)

(52) U.S. Cl.
CPC ..... *F04B 27/1081* (2013.01); *F04B 27/0891* (2013.01); *F04B 27/1036* (2013.01); *F04B 39/122* (2013.01); *F04B 39/125* (2013.01); *F04B 53/007* (2013.01)

(58) Field of Classification Search
CPC .... F04B 27/10; F04B 27/109; F04B 27/1036; F04B 27/1081; F04B 27/0891; F04B 9/04; F04B 9/042; F04B 39/121; F04B 39/122; F04B 39/125; F04B 39/127; F04B 39/128; F04B 1/2078; F04B 1/2092; F04B 1/26; F04B 53/007
USPC ..... 417/222.1, 222.2, 269, 271; 91/499, 91/505, 506
See application file for complete search history.

(56) References Cited

U.S. PATENT DOCUMENTS 3,749,523 A 7/1973 Wahl, Jr.
3,801,227 A 4/1974 Nakayama
(Continued)

FOREIGN PATENT DOCUMENTS

DE 2922307 12/1979
DE 19944477 3/2000
(Continued)

OTHER PUBLICATIONS

Korean Office Action, dated Apr. 15, 2014.
(Continued)

*Primary Examiner* — Devon Kramer
*Assistant Examiner* — Chirag Jariwala
(74) *Attorney, Agent, or Firm* — Greenblum & Bernstein, P.L.C.

(57) ABSTRACT

A swash plate type compressor includes a cylinder block having a crank chamber, a rotary shaft, a swash plate, pistons and fasteners extending through the crank chamber between any two adjacent pistons. The cylinder block further includes ribs projecting inward from inner surface of the crank chamber, extending in axial direction of the rotary shaft and being arranged so that the pistons and the fasteners are positioned alternately between any two adjacent ribs, a piston-side wall surface forming the inner surface and being positioned between any two adjacent ribs located on opposite side of the piston and a fastener-side wall surface forming the inner surface and being positioned between any two adjacent ribs located on opposite side of the fastener The piston-side wall surface is spaced farther away from the rotary shaft than the fastener-side wall surface in radial direction of the rotary shaft.

6 Claims, 4 Drawing Sheets

(51) Int. Cl.
*F04B 39/12* (2006.01)
*F04B 53/00* (2006.01)

(56) References Cited

U.S. PATENT DOCUMENTS

| | | | |
|---|---|---|---|
| 4,289,453 | A | 9/1981 | Shibuya |
| 4,321,019 | A | 3/1982 | Degawa et al. |
| 6,179,576 | B1 | 1/2001 | Morita |
| 6,862,975 | B2 | 3/2005 | Shintoku et al. |
| 2003/0141149 | A1 | 7/2003 | Shintoku et al. |
| 2007/0269319 | A1 | 11/2007 | Inoue et al. |

FOREIGN PATENT DOCUMENTS

| | | |
|---|---|---|
| JP | 52-18208 | 2/1977 |
| JP | 52-36312 | 3/1977 |
| JP | 57-121782 | 7/1982 |
| JP | 2000-018154 | 1/2000 |
| JP | 2000-097150 | 4/2000 |
| JP | 2003-247488 | 9/2003 |
| KR | 10-0840916 | 6/2008 |

OTHER PUBLICATIONS

China Office action, mail date is Apr. 3, 2015 along with an English language translation thereof.

Prior Art

SWASH PLATE TYPE COMPRESSOR

BACKGROUND OF THE INVENTION

The present invention relates to a swash plate type compressor which includes a cylinder block having formed therethrough a plurality of cylinder bores, a rotary shaft rotatably supported by the cylinder block, a swash plate fixed on the rotary shaft for rotation therewith and a plurality of pistons reciprocally slidable received in the cylinder bores and each engaged with the swash plate, wherein the cylinder block has formed therein a chamber accommodating therein the swash plate.

FIG. 4 shows a prior art swash plate type compressor which is disclosed by Japanese Patent Application Publication 2003-247488 and designated by 80 in the drawing. The swash plate type compressor 80 includes a housing 81 formed by a pair of cylinder blocks 90, a rotary shaft 82 rotatably supported by the cylinder block 90, a swash plate 83 fixed on the rotary shaft 82 for rotation therewith and a plurality of pistons 84. The cylinder block 90 has formed therethrough a plurality of cylinder bores 85 receiving therein the respective pistons 84 and a crank chamber 86 (or a swash plate chamber) accommodating therein the swash plate 82. The pistons 84 are engaged with the swash plate 83 and reciprocally slidable in the respective cylinder bores 85.

The compressor 80 further includes a rear housing having formed therein a suction chamber 87. A suction passage 88 is formed axially in the rotary shaft 82 for introducing refrigerant gas in the suction chamber 87 into the cylinder bore 85. The rotary shaft 82 has also formed therein a plurality of oil passages 89 extending in radial direction of the rotary shaft 82 for supplying lubricating oil contained in refrigerant gas to the crank chamber 86. Lubricating oil contained in refrigerant gas in the suction passage 88 is supplied to the crank chamber 86 by the centrifugal force resulting from the rotation of the rotary shaft 82.

The cylinder block 90 has also formed therethrough a communication passage 91 for providing fluid communication between the crank chamber 86 and the suction chamber 87. While the swash plate type compressor 80 is operating at a high speed, lubricating oil in the crank chamber 86 returns with refrigerant gas through the communication passage 91 to the suction chamber 87 that is lower in pressure than the crank chamber 86, so that the lubricating oil is prevented from being accumulated excessively in the crank chamber 87.

However, the lubricating oil accumulated in the crank chamber 86, stirred by the swash plate 83 and the piston 84 and splashed during the operation of the swash plate type compressor 80 offers resistance against the rotation of the swash plate 83. To prevent the lubricating oil from being stirred by the swash plate 83 in the crank chamber 86, it may be so arranged that the lubricating oil level in the crank chamber 86 is lowered so as to be located below the space where the swash plate 83 rotates and the piston 84 reciprocates. In order to lower the oil level without increasing the overall size of the swash plate type compressor 80, however, the diameter of the crank chamber 80 need be increased so as to increase the inner volume thereof because the size of the compressor 80 is restricted. In this case, the rigidity of the housing 81 may be reduced at positions around the bolts 92 fastening components (such as the cylinder blocks 90, etc.) that form the housing 81 of the swash plate type compressor 80, with the result that the housing 81 may be deformed and the fluid tightness thereof may be reduced, accordingly.

The present invention is directed to providing a swash plate type compressor which prevents lubricating oil in the crank chamber of the compressor from being stirred by the swash plate and ensures the fluid tightness of the housing, without increasing the size of the housing of the compressor.

SUMMARY OF THE INVENTION

A swash plate type compressor includes a cylinder block having a crank chamber, a rotary shaft, a swash plate, pistons and fasteners extending through the crank chamber between any two adjacent pistons. The cylinder block further includes ribs projecting inward from inner surface of the crank chamber, extending in axial direction of the rotary shaft and being arranged so that the pistons and the fasteners are positioned alternately between any two adjacent ribs, a piston-side wall surface forming the inner surface and being positioned between any two adjacent ribs located on opposite side of the piston and a fastener-side wall surface forming the inner surface and being positioned between any two adjacent ribs located on opposite side of the fastener The piston-side wall surface is spaced farther away from the rotary shaft than the fastener-side wall surface in radial direction of the rotary shaft.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
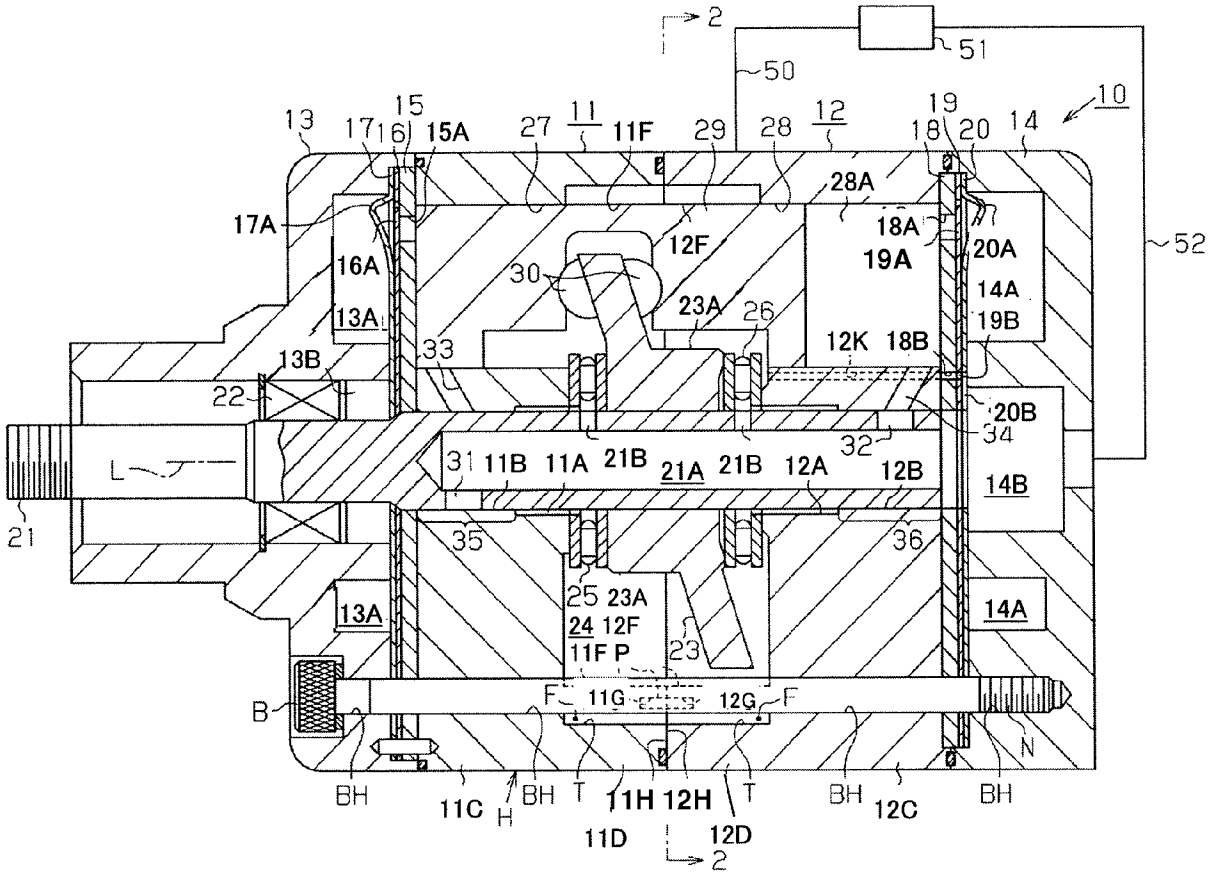
FIG. 1 is a longitudinal cross-sectional view of a swash plate type compressor with a double-headed piston according to a preferred embodiment of the present invention.

The following will describe the swash plate type compressor with a double-headed piston (hereinafter simply referred to as compressor) according to the preferred embodiment of the present invention with reference to FIGS. 1 through 3. As shown in FIG. 1, the compressor which is designated generally by numeral 10 includes a housing H. The housing H includes a pair of front and rear cylinder blocks 11, 12, a front housing 13 joined to the front cylinder block 11 and a rear housing 14 joined to the rear cylinder block 12. The front and the rear cylinder blocks 11, 12 and the front and the rear housings 13, 14 are fastened together by a plurality of bolts B (e.g. five bolts B) serving as the fastener of the present invention. Thus, the front and the rear cylinder blocks 11, 12 and the front and the rear housings 13, 14 cooperate to form the housing H of the compressor 10.

As shown in FIG. 1, a plurality of aligned holes BH (only one hole BH being shown in the drawing) is formed through the front and the rear cylinder blocks 11, 12 and the front housing 13 and in the rear housing 14. As shown in FIG. 2, the holes BH are angularly spaced around a rotary shaft 21 which will be described later herein. The hole BH in the rear housing 14 is threaded at N for engagement with the externally threaded end of the bolt B passing through the front and the rear cylinder blocks 11, 12 and the front housing 13. The front and the rear cylinder blocks 11, 12 and the front and the rear housings 13, 14 serve as the housing member according to the present invention.

As shown in FIG. 1, a valve port plate 15, a valve plate 16 and a retainer plate 17 are interposed between the front housing 13 and the front cylinder block 11. Similarly, a valve port plate 18, a valve plate 19 and a retainer plate 20 are interposed between the rear housing 14 and the rear cylinder block 12. The valve port plates 15, 18 have formed therethrough discharge ports 15A, 18A, respectively, and the valve plates 16, 19 have formed therein discharge valves 16A, 19A opening and closing the discharge ports 15A, 18A, respectively. The retainer plates 17, 20 are formed with retainers 17A, 20A that regulate the opening degree of the discharge valves 16A, 19A, respectively.

A discharge chamber 13A is formed between the front housing 13 and the valve port plate 15. A discharge chamber 14A and a suction chamber 14B are formed between the rear housing 14 and the valve port plate 18. Refrigerant gas discharged into the discharge chambers 13A, 14A flows to external refrigerant circuit 51 through a hole (not shown) and a tube 50. Refrigerant gas in the external refrigerant circuit 51 returns to the compressor 10 through the tube 52 and the suction chamber 14B. The compressor 10 and the external refrigerant circuit 51 cooperate to form a refrigerant circulation circuit. Refrigerant gas containing lubricating oil circulates through the refrigerant circulation circuit, so that the lubricating oil in refrigerant gas lubricates the sliding parts of the compressor 10.

The aforementioned rotary shaft 21 is rotatably supported in the housing H. The part of the rotary shaft 21 which is located in the front of the housing H passes through a shaft hole 11A formed through the front cylinder block 11. The part of the rotary shaft 21 which is located in the rear of the housing H passes through a shaft hole 12A formed through the rear cylinder block 12. The rotary shaft 21 is rotatably supported by the front cylinder block 11 at the shaft hole 11A and by the rear cylinder block 12 at the shaft hole 12A. A lip type shaft seal 22 is interposed between the front housing 13 and the rotary shaft 21 and accommodated in a seal chamber 13B formed in the front housing 13. The discharge chamber 13A is formed in the front housing 13 around and outward of the seal chamber 13B.

The swash plate 23 is fixedly mounted on the rotary shaft 21 for rotation therewith. The housing H that is formed by a pair of the front and the rear cylinder blocks 11, 12 has formed therein a crank chamber 24 accommodating therein the swash plate 23. Thrust bearing 25, 26 are interposed between the rear end of the front cylinder block 11 and annular base 23A of the swash plate 23 and between the front end of the rear cylinder block 12 and annular base 23A of the swash plate 23, respectively, and hold the swash plate 23 therebetween to prevent the rotary shaft 21 from being moved in the axial direction thereof.

The front and the rear cylinder blocks 11, 12 have formed therethrough a plurality of cylinder bores (five cylinder bores in the illustrated embodiment) angularly spaced around the rotary shaft 21 and each receiving therein a double-headed piston 29. Each cylinder bore is divided by the double-headed piston 29 into a pair of front and rear cylinder bores 27, 28. Each double-headed piston 29 is reciprocally slidable in its associated cylinder bores 27, 28 in the axial direction thereof. The double-headed piston 29 is engaged with the swash plate 23. The double-headed piston 29 serves as the piston of the present invention. The bolts B extend through the front and the rear cylinder blocks 11, 12 and also through the crank chamber 24 parallel to the rotary shaft 21 at positions between any two adjacent double-headed pistons 29.

The swash plate 23 rotates with the rotary shaft 21 integrally and the rotating movement of the swash plate 23 is converted through a pair of shoes 30 into the reciprocal movement of the double-headed piston 29 in its corresponding pair of front and rear cylinder bores 27, 28. Each of the valve port plates 15, 18 and the double-headed piston 29 cooperate to form a compression chamber 28A in the front and the rear cylinder bores 27, 28, respectively.

Sealing surfaces 11B, 12B are formed on the inner peripheries of the shaft holes 11A, 12A, respectively, through which the rotary shaft 21 is inserted. The rotary shaft 21 is supported directly by the front and the rear cylinder blocks 11, 12 at the sealing surfaces 11B, 12B, respectively. The rotary shaft 21 has formed therein a supply passage 21A that extends axially and is in communication at the rear end thereof with the suction chamber 14B. The rotary shaft 21 has also formed therein radial oil holes 21B that allow the supply passage 21A to be in communication with the crank chamber 24. The oil holes 21B are formed at positions where the oil holes 21B face the respective thrust bearings 25, 26.

The rear cylinder block 12 has formed therethrough at a position that is radially outward of the shaft hole 12A a release passage 12K that extends in the axial direction of the rotary shaft 21 and is opened at the opposite ends thereof to the crank chamber 24 and to the valve port plate 18, respectively. The valve port plate 18 and the valve plate 19 have formed therethrough at a position corresponding to the release passage 12K communication holes 18B, 19B, respectively. The retainer plate 20 has formed therethrough a communication hole 20B that allows the communication hole 19B to be in communication with the suction chamber 14B. Therefore, the crank chamber 24 is in communication with the suction chamber 14B through the release passage 12K and the communication holes 18B, 19B, 20B. The release passage 12K and the communication holes 18B, 19B, 20B cooperate to form the return passage of the present invention.

The rotary shaft 21 has formed therein a first introduction hole 31 that faces the front cylinder block 11 and also a second introduction hole 32 that faces the rear cylinder block 12. The front cylinder block 11 has formed therein a plurality of first suction passages 33 that allow the shaft hole 11A of the front cylinder block 11 to be in communication with the respective front cylinder bores 27. Similarly, the rear cylinder block 12 has formed therein a plurality of second suction passages 34 that allow the shaft hole 12A of the rear cylinder block 12 to be in communication with the respective rear cylinder bores 28. The part of the rotary shaft 21 surrounded by the sealing surface 11B of the front cylinder block 11 forms a first rotary valve 35. Similarly, the part of the rotary shaft 21 surrounded by the sealing surface 12B of the rear cylinder block 12 forms a second rotary valve 36.

In the front cylinder block 11, when the first introduction hole 31 is in communication with the first suction passage 33 while the double-headed piston 29 is moving toward the bottom dead center, refrigerant gas in the supply passage 21A is drawn into the corresponding front cylinder bore 27. Subsequently, the refrigerant gas drawn into the front cylinder bore 27 is compressed by the movement of the double-headed piston 29 toward the top dead center.

While refrigerant gas is being compressed in the front cylinder bore 27, the double-headed piston 29 moves toward the bottom dead center in the corresponding rear cylinder bore 28. When the second introduction hole 32 is in communication with the second suction passage 34 during such movement of the double-headed piston 29, refrigerant gas in the supply passage 21A is drawn into the rear cylinder bore 28. While refrigerant gas is being drawn into the front cylinder bore 27, in the corresponding rear cylinder bore 28, the double-headed piston 29 moves toward the top dead center of the corresponding rear cylinder bore 28 for compression of refrigerant gas. Refrigerant gas that is compressed in the front and the rear cylinder bores 27, 28 is discharged into the discharge chambers 13A, 14A through the discharge ports 15A, 18A while pushing open the discharge valves 16A, 19A, respectively.

Figure 2:
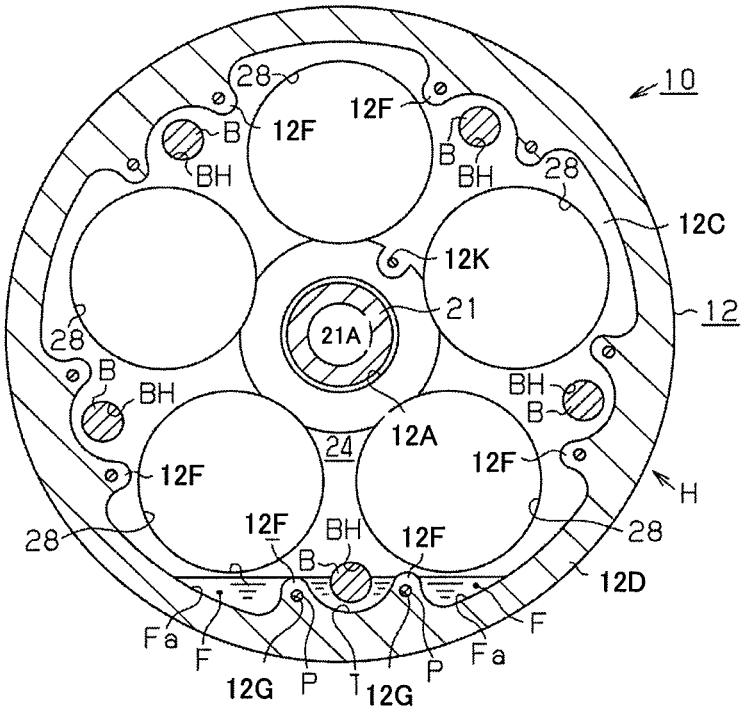
FIG. 2 is a cross-sectional view taken along the line 2-2 in FIG. 1, showing a cylinder block, a rib and an oil reservoir of the swash plate type compressor of FIG. 1.
Figure 3:
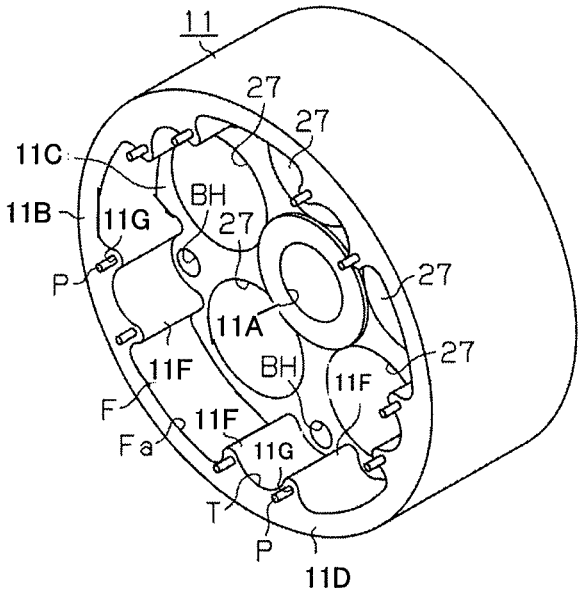
FIG. 3 is a perspective view of the cylinder block of FIG. 1.
Figure 4:
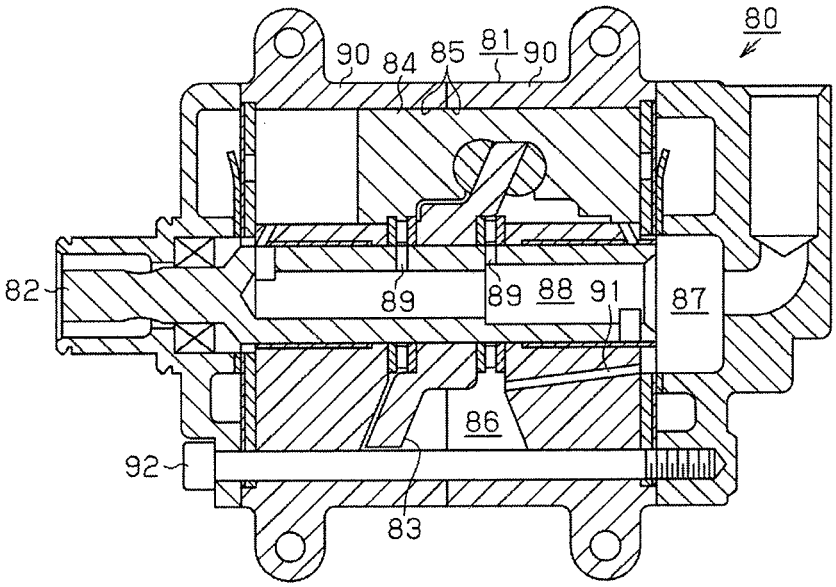
FIG. 4 is a longitudinal cross-sectional view of a prior art swash plate type compressor.

As shown in FIGS. 2 and 3, an oil reservoir F is formed in the front and the rear cylinder blocks 11, 12. As shown in FIGS. 1 through 3, the front and the rear cylinder blocks 11, 12 include disc-shaped bases 11C, 12C and annular peripheral walls 11D, 12D extending from the outer periphery of the bases 11C, 12C, respectively. The aforementioned holes BH for the bolts B are formed through the bases 11C, 12C. With the front and the rear cylinder blocks 11, 12 joined and fastened together by the bolts B, the bases 11C, 12C and the peripheral walls 11D, 12D cooperate to form the crank chamber 24 between the front and the rear cylinder blocks 11, 12.

The peripheral walls 11D, 12D forming the crank chamber 24 have a plurality of ribs 11F, 12F projecting inward from inner surfaces of the peripheral walls 11D, 12D, respectively. The ribs 11F, 12 F extend in the axial direction of the rotary shaft 21 and are spaced angularly around the rotary shaft 21 from each other. The ribs 11F, 12F are arranged in the circumferential direction of the peripheral wall 11D, 12D so that the double-headed pistons 29 and the bolts B are positioned alternately between any two adjacent ribs 11F, 12F in the front and the rear cylinder blocks 11, 12, respectively. With the front and the rear cylinder blocks 11, 12 joined together, the ribs 11F of the front cylinder block 11 and the ribs 12F of the rear cylinder block 12 are set in contact with each other, respectively. 11H and 12H designate joint surfaces of the front and the rear cylinder blocks 11, 12, respectively. The joint surfaces 11H, 12H extend perpendicularly to the axis of the rotary shaft 21. The end surfaces of the ribs 11F, 12F are flush with the joint surfaces 11H, 12H of the front and the rear cylinder blocks 11, 12, respectively. The provision of the ribs 11F, 12F help to enhance the rigidity of the joint surfaces 11H, 12H of the front and the rear cylinder blocks 11, 12, respectively.

Recesses 11G, 12G are formed in ends of the ribs 11F, 12F so as to extend in the axial direction of the front and the rear cylinder blocks 11, 12, respectively and locating pins P are inserted in the recesses 11G, 12G.

The following will describe the oil reservoir F in detail. As shown in FIGS. 2 and 3, the oil reservoir F is formed between the adjacent ribs 11F, 12F located adjacent to the one double-headed piston 29, respectively. The part of the peripheral walls 11D, 12D that forms the bottom of each oil reservoir F is formed thinner than the part of the peripheral walls 11D, 12D between the adjacent ribs 11F, 12F located adjacent to the bolt B, respectively. Each of the ribs 11F, 12F is curved so that the end thereof overhangs the oil reservoir F. Specifically, the ribs 11F, 12F are formed so that the distance between the two adjacent ribs 11F, 12F which form therebetween the oil reservoir F, as measured along the circumferential direction of the peripheral walls 11D, 12D, increases generally toward the bottom of the oil reservoir F. Thus, the volume of the oil reservoir F is increased.

The part of the inner surface of the peripheral walls 11D, 12D forming the crank chamber 24 between the two adjacent ribs 11F, 12F located on opposite side of the lowermost double-headed piston 29 will be referred to as the piston-side wall surface Fa. On the other hand, the part of the inner surface of the peripheral walls 11D, 12D forming the crank chamber 24 between the two adjacent ribs 11F, 12F located on opposite side of the lowermost bolt B will be referred to as the fastener-side wall surface T. The piston-side wall surface Fa forms the bottom of the oil reservoir F. The piston-side wall surface Fa is spaced farther away from the rotary shaft 21 than the fastener-side wall surface T as seen in the radial direction of the rotary shaft 21. The peripheral walls 11D, 12D forming the piston-side wall surface Fa are formed thinner than the peripheral walls 11D, 12D forming the fastener-side wall surface T, so that the volume of the oil reservoir F can be increased.

The part of the peripheral walls 11D, 12D which forms the piston-side wall surfaces Fa is formed with a constant thickness. On the other hand, the part of the peripheral walls 11D, 12D which forms the fastener-side wall surface T is formed so that the fastener-side wall surface T is arcuate in shape between the two adjacent ribs 11F, 12F located on opposite sides of the bolt B. Furthermore, the part of the peripheral walls 12D which forms the fastener-side wall surface T is formed with a thickness that is greater than that forming the piston-side wall surface Fa, so that the rigidity of the front and the rear cylinder blocks 11, 12 and the fluid tightness thereof at the joint surfaces 11H, 12H are ensured. Lubricating oil flowed into the crank chamber 24 can be accumulated in the oil reservoir F.

The following will describe the operation of the compressor 10. During the operation of the compressor 10, lubricating oil contained in refrigerant gas in the supply passage 21A is separated from the refrigerant gas by the centrifugal force due to the rotation of the rotary shaft 21 and flows into the crank chamber 24 through the oil hole 21B. Thus, the lubricating oil is supplied to the crank chamber 24 and accumulated in the oil reservoir F.

The amount of lubricating oil flowed into the crank chamber 24 through the oil hole 21B by the centrifugal force varies according to the rotational speed of the rotary shaft 21. The amount of lubricating oil that flows into the crank chamber 24 is increased with an increase of the rotational speed of the rotary shaft 21. During the high-speed operation of the compressor 10 when the pressure in the suction chamber 14B is lower than that in the crank chamber 24, airborne lubricating oil that exists in the form of mist in the crank chamber 24 is returned with refrigerant gas to the suction chamber 14B, the pressure of which is lower than that of the crank chamber 24, through the return passage (or the release passage 12K and the communication holes 18B, 19B, 20B) and then flows through the refrigerant circulation circuit. On the other hand, during the low-speed operation of the compressor 10 when the pressure difference between the crank chamber 24 and the suction chamber 14B is small, only a small amount of lubricating oil flows into the suction chamber 14B.

During the operation of the swash plate type compressor, part of the lubricating oil that flows into the crank chamber 24 but fails to be returned to the suction chamber 14B is attached to inner surface of the crank chamber 24 and then accumulated in the oil reservoir F. Referring to FIGS. 2 and 3, the ribs 11F, 12F forming the oil reservoir F are formed to be curved so as to increase the opening of the oil reservoir F. The volume of the oil reservoir F is increased by spacing the piston-side wall surface Fa farther away from the rotary shaft 21 than the fastener-side wall surface T as seen in the radial direction of the rotary shaft 21. Therefore, the oil level of lubricating oil accumulated in the oil reservoir F may be located below the space where the swash plate 23 rotates and the double-headed piston 29 reciprocates.

Therefore, the lubricating oil accumulated in the oil reservoir F is prevented from being stirred in the crank chamber 24 by the swash plate 23 and the double-headed piston 29, so that the lubricating oil is prevented from becoming resistance against the rotation of the swash plate 23.

The swash plate type compressor according to the preferred embodiment offers the following advantageous effects.

(1) The front and the rear cylinder blocks 11, 12 forming the crank chamber 24 are formed with the ribs 11F, 12F that project inward from the inner surfaces of the front and the rear cylinder block 11, 12 and ensure the rigidity of the joint surfaces 11H, 12H of the front and the rear cylinder blocks 11, 12, respectively. The ribs 11F, 12F form the oil reservoir F in the crank chamber 24. The piston-side wall surface Fa at the bottom of the oil reservoir F is spaced farther away from the rotary shaft 21 than the fastener-side wall surface T as seen in the radial direction of the rotary shaft 21, so that the volume of the oil reservoir F is increased. As compared with a case wherein lubricating oil is accumulated in the bottom of the crank chamber 24 without the oil reservoir such as F of the present embodiment, the oil level of lubricating oil accumulated in the crank chamber 24 of the compressor 10 according to the preferred embodiment can be lowered below the space where the swash plate 23 rotates and the double-headed piston 29 reciprocates. Therefore, lubricating oil accumulated in the oil reservoir F is prevented from being stirred in the crank chamber 24 by the swash plate 23 and the double-headed piston 29, so that a state where the lubricating oil becomes rotational resistance against the swash plate 23 can be forestalled.

(2) The piston-side wall surface Fa of the inner surface of the crank chamber 24 is spaced farther away from the rotary shaft 21 than the fastener-side wall surface T as seen in the radial direction of the rotary shaft 21. The piston-side wall surface Fa and the two adjacent ribs 11F, 12F located adjacent to one double-headed piston 29 cooperate to form the oil reservoir F. Therefore, the peripheral walls 11D, 12D between the two adjacent ribs 11F, 12F located on opposite sides of the bolt B is thicker than that between the above two adjacent ribs 11F, 12F located adjacent to the one double-headed piston 29. Therefore, the peripheral walls 11D, 12D adjacent to the bolts B can be made thick enough to ensure the strength. Lubricating oil accumulated in the oil reservoir F can be prevented from being stirred without making the housing H large. Additionally, the housing H whose rigidity is ensured by the ribs 11F, 12F can resist the deformation around the bolt B which may occur when the front and the rear cylinder blocks 11, 12 and the front and the rear housings 13, 14 are fastened tightly together by the bolts B into the housing H. As a result, the front and the rear cylinder blocks 11, 12 are sealed hermetically at the joint surfaces 11H, 12H, respectively, so that the fluid tightness of the housing H can be ensured.

(3) During the low-speed operation of the compressor 10 when small amount of lubricating oil is separated from refrigerant gas by the centrifugal force of the rotary shaft 21, it is preferable that lubricating oil should stay in the crank chamber 24 as much as possible for lubricating the sliding parts of the compressor 10. In the present preferred embodiment, the oil reservoir F is formed in the crank chamber 24 where lubricating oil can be accumulated, so that lubricating oil is prevented from being stirred during the low-speed operation of the compressor 10. Therefore, the quantity of lubricating oil that flows through the return passage and is returned to the suction chamber 14B is restricted, so that sufficient lubricating oil can remain in the crank chamber 24 for lubricating the sliding parts of the compressor 10.

(4) The oil reservoir F is formed by making use of the ribs 11F, 12F that are formed to ensure the rigidity of the joint surfaces 11H, 12H of the front and the rear cylinder blocks 11, 12, respectively. Therefore, the crank chamber 24 need not be made large so as to lower the oil level of lubricating oil and, therefore, the housing H need not be increased in size, either. According to the embodiment of the present invention, the ribs 11F, 12F which are formed to ensure the rigidity of the front and the rear cylinder blocks 11, 12 are formed so as to form the oil reservoir F. As compared with a case wherein any members other than the ribs 11F, 12F are provided for forming the oil reservoir F, the structure according to the present embodiment for preventing lubricating oil from being stirred can be simplified and contribute to decreasing the manufacturing cost.

(5) The front and the rear cylinder blocks 11, 12 and the front and rear housings 13, 14 are fastened together into the housing H by a plurality of bolts B. The cylinder blocks 11, 12 are formed with a plurality of ribs 11F, 12F projecting in the crank chamber 24 at positions between the bolt B and the double-headed piston 29 that are located adjacent to each other. A pair of the ribs 11F, 12F is used to form a plurality of oil reservoirs F in the crank chamber 24. Therefore, lubricating oil can be accumulated in the plurality of oil reservoirs F separately, so that the oil level of lubricating oil can be lowered.

(6) The peripheral walls 11D, 12D corresponding to the aforementioned piston-side wall surface Fa that is exposed to the lubricating oil in the oil reservoirs F are formed to be thin. Each of the ribs 11F, 12F is curved so that the end thereof overhangs the piston-side wall surface Fa (or the oil reservoir F). In other words, the ribs 11F, 12F are formed to be thin on the side thereof that is exposed to the oil reservoir F. Therefore, the opening of the oil reservoir F between the two adjacent ribs 11F, 12F that are located adjacent to one double-headed piston 29 can be increased, so that the volume of the oil reservoir F can be increased. Therefore, the oil level of lubricating oil accumulated in the oil reservoir F can be lowered.

(7) The peripheral walls 11D, 12D of the front and the rear cylinder blocks 11, 12 which form the piston-side wall surface Fa of the oil reservoir F, respectively, are formed thinner than the peripheral walls 11D, 12D that form the fastener-side wall surface T. In other words, the piston-side wall surface Fa is spaced farther away from the rotary shaft 21 than the fastener-side wall surface T as seen in the radial direction of the rotary shaft 21. Therefore, the depth of the oil reservoir F and hence the volume of the oil reservoir F can be increased and the oil surface of lubricating oil can be lowered, accordingly, while ensuring the rigidity of the front and the rear cylinder blocks 11, 12 and the fluid tightness of the housing H.

(8) The provision of the locating pins P that are inserted into the recesses 11G, 12G formed in the ribs 11F, 12F of the front and the rear cylinder blocks 11, 12, respectively, facilitates positioning of the front and the rear cylinder blocks 11, 12 in assembling the housing H, with the result that the housing H can be manufactured easily. Additionally, the recesses 11G, 12G formed in the end of the respective ribs 11F, 12F serving as part of the joint surfaces 11H, 12H of the front and the rear cylinder blocks 11, 12, respectively, help to enhance the fluid tightness of the housing H.

The compressor 10 according to the preferred embodiment can be modified in various ways as exemplified below.

Although in the preferred embodiment, the oil reservoir F is formed by all the ribs 11F, 12F, the oil reservoir F may be formed by only the ribs 11F, 12F that are located in the bottom side of the crank chamber 24.

As long as the oil reservoir F is positioned below the space where the swash plate 23 rotates and the double-headed piston 29 reciprocates, the ribs 11F, 12F need not be formed to be thin on the side of the ribs 11F, 12F exposed to the oil reservoir F and the peripheral walls 11D, 12D forming the piston-side wall surface Fa need not be formed to be thin.

The compressor 10 may dispense with the recesses 11G, 12G and the locating pin P.

The compressor 10 may be of a single-headed type wherein a single-headed piston is engaged with the swash plate 23.

What is claimed is:

1. A swash plate type compressor comprising:

a housing including:

a cylinder block having a crank chamber and a plurality of cylinder bores;

a plurality of housing members; and a plurality of fasteners fastening the cylinder block and the plurality of housing members that form the housing;

a rotary shaft rotatably supported by the cylinder block;

a swash plate fixedly mounted on the rotary shaft for rotation therewith; and a plurality of pistons engaged with the swash plate and reciprocally slidable in the cylinder bore, wherein the fastener extends through the crank chamber parallel to the rotary shaft at a position between any two adjacent pistons, wherein the cylinder block further includes:

a plurality of ribs, each of the ribs projecting inward from an inner surface of the crank chamber, extending in an axial direction of the rotary shaft and being arranged so that the pistons and the fasteners are positioned alternately between any two adjacent ribs;

a piston-side wall surface that forms the inner surface of the crank chamber and is positioned between any two adjacent ribs located on opposite side of the piston; and a fastener-side wall surface that forms the inner surface of the crank chamber and is positioned between any two adjacent ribs located on opposite side of the fastener, wherein the piston-side wall surface is spaced farther away from the rotary shaft than the fastener-side wall surface in radial direction of the rotary shaft.

2. The swash plate type compressor according to claim 1, wherein the cylinder block is formed by a pair of front and rear cylinder blocks.

3. The swash plate type compressor according to claim 2, wherein each of the front and the rear cylinder blocks includes a joint surface that extends perpendicularly to the axis of the rotary shaft and is flush with an end surface of the rib, wherein the front and the rear cylinder blocks are joined together at the joint surface, wherein the rib includes a recess formed in an end of the rib and opened at the end surface of the rib so that a locating pin is inserted in the recess.

4. The swash plate type compressor according to claim 1, wherein the rib is curved so that end of the rib overhangs the piston-side wall surface.

5. The swash plate type compressor according to claim 1, wherein the piston is a double-headed piston.

6. The swash plate type compressor according to claim 1, wherein the cylinder block includes an oil reservoir formed by any two adjacent ribs located on opposite side of the piston and the piston-side wall surface forms a bottom of the oil reservoir.

* * * * *